United States Patent [19]

Redmon, Jr. et al.

[11] Patent Number: 4,821,610

[45] Date of Patent: Apr. 18, 1989

[54] SELF-LOCKING CLAMPING TOOL WITH SWIVEL JAWS

[75] Inventors: John W. Redmon, Jr., Huntsville, Ala.; Fred Jankowski, Titusville, Fla.

[73] Assignee: The United States of America as represented by the Administrator of the National Aeronautics and Space Administration, Washington, D.C.

[21] Appl. No.: 87,370

[22] Filed: Aug. 20, 1987

[51] Int. Cl.[4] ..... B25B 7/14

[52] U.S. Cl. ..... 81/322; 81/418; 81/387; 269/258

[58] Field of Search ..... 81/322, 320, 321, 323, 81/324, 325, 326, 327, 328, 329, 330, 331, 332, 348, 405, 406, 407, 424, 425.5, 385, 386, 387, 392, 393, 394, 346, 347, 352, 381, 16, 15.9, 450, 417, 418; 269/6, 258

[56] References Cited

U.S. PATENT DOCUMENTS

| | | | |
|---|---|---|---|
| 2,577,008 | 12/1951 | Engstrom | 81/322 |
| 2,656,865 | 10/1953 | Bright | 81/450 |
| 2,706,921 | 4/1955 | Paulson | 81/346 |
| 2,990,213 | 6/1961 | Kolacinski | 81/424 |
| 4,601,221 | 7/1986 | Brenner | 269/258 |

FOREIGN PATENT DOCUMENTS

| | | | |
|---|---|---|---|
| 0022423 | of 1911 | United Kingdom | 81/450 |

*Primary Examiner*—Frederick R. Schmidt
*Assistant Examiner*—Blynn Shideler
*Attorney, Agent, or Firm*—William J. Sheehan; John R. Manning; Charles E. B. Glenn

[57] ABSTRACT

A plier-like tool (11) having two plier-like members (13, 15) pivotally joined togther intermediate of their ends and having handle portions (17, 18) and swivel jaw members (29,30). An automatic locking mechanism (27) extending between the members permits an user to clamp the handle portions together so as to clamp the jaw members on an object (25) but holds the position so reached if the clamping action of the user is removed. A release device (65) is provided so that the jaw members may be opened up again. A compression spring (23) extending between the members (19, 20) assists in the opening of the jaw members. The swivel jaw members (29, 30) permit the user to rotate the plier-like members (13,15) relative to the object (25) being grasped.

8 Claims, 3 Drawing Sheets

SELF-LOCKING CLAMPING TOOL WITH SWIVEL JAWS

ORIGIN OF THE INVENTION

The invention described herein was made by employees of the United States Government and may be manufactured and used by or for the Government of the United States of America for governmental purposes without the payment of any royalties thereon of therefor.

TECHNICAL FIELD

This invention relates to plier-like tools and more particularly to a hand tool with pivoting jaws designed for gripping an object.

BACKGROUND OF THE INVENTION

Plier-like tools conventionally have gripping jaws which are fixed at a particular angle relative to the jaws and this results in the tool user grasping or gripping an object at a set angle and generally being constrained in his movement and turning of the gripped object.

Further these plier-like tools require the user to grip the handles and turn the tool simultaneously to manipulate the object being gripped. These deficiencies in operation of plier-like tools present formidable operating problems for astronauts working in space because their pressurized suits reduce their manual dexterity. Also in the relative clamped quarters of space vehicles some objects such as electrical connectors are essentially inaccessible to direct view and the gloved hand of the astronaut when used in placing or removing an connector prevents a clear view of the connector. Sharp edges about a connector do present a problem as they could damage the glove during hand turning of the connector.

STATEMENT OF THE INVENTION

A self-locking plier-like tool to overcome the disadvantages of prior devices is provided. The new tool has swivel jaw members which permit the tool to rotate in an indexed manner along a plane relative to the object being gripped by the jaw members. The self-locking feature works automatically to permit the handle portions of the tool to be squeezed together by an user's hands causing the plier-like jaw members to squeeze and clamp an object but prevents the handle portions from opening or moving in the opposite direction so as to lose the clamping action on the object when the hand relaxes its grip and squeezing action. A release mechanism is provided to permit the handle portions and thus the jaw members to open up and release the clamped object. The swivel jaw members have rubber pads to provide a tactile feel of the jaws being clamped on an object.

The self-locking feature is accomplished by a ratchet gear fixed to one of the plier-like members cooperating with a pawl fixed to the other of the plier-like members. The release mechanism has a shaft attached to the pawl which when rotated by the action of a lever accessible to the user causes the pawl to pull away from the ratchet gear and unlock the handles and thereby permit an opening movement.

DETAILED DESCRIPTION OF THE INVENTION

Figure 2:
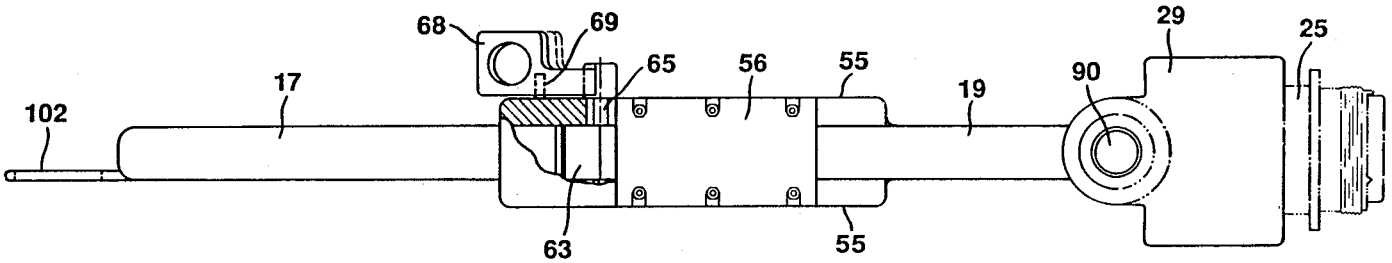
FIG. 2 is a top view partly in section of the tool of FIG. 1.
Figure 1:
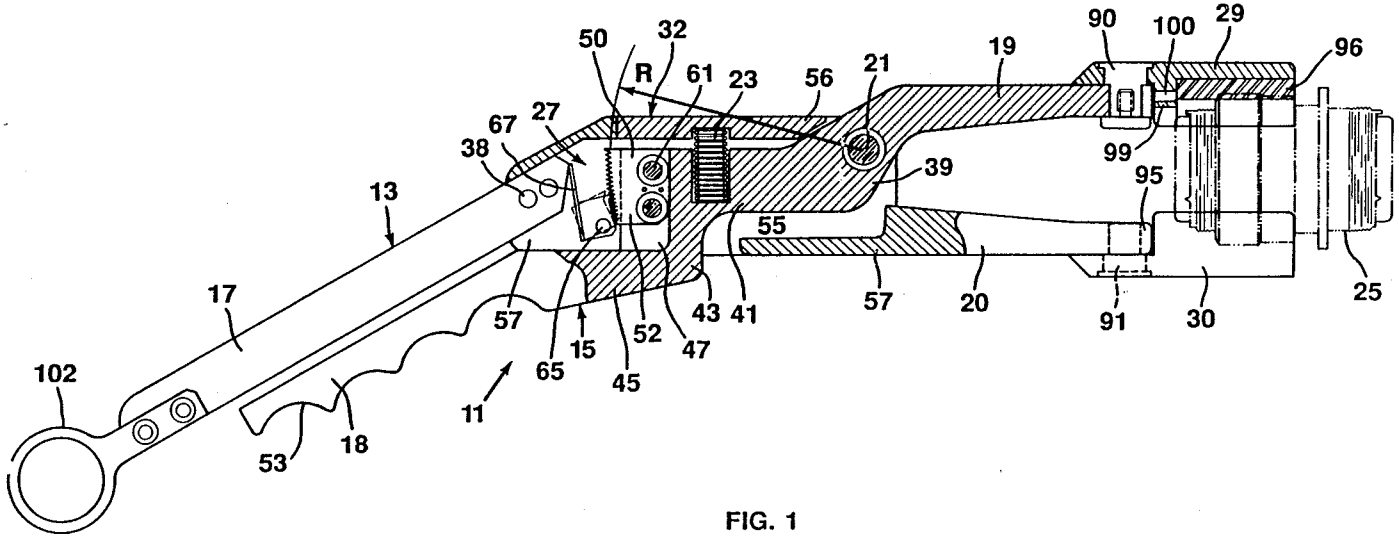
FIG. 1 side view partly in section of the self-locking tool according to the present invention.

Referring to the drawings, particularly FIG. 1, wherein is shown the self-locking clamping tool 11 of the present invention. As shown the clamping tool 11 comprises two plier-action members 13, 15 with handle portions 17, 18 forming one end and jaw members 19, 20 forming the opposite end. The plier-action members 13, 15 are pivotally joined together intermediate of their ends by a screw fastener 21 and have a compression spring 23 extending between the members rearwardly of the pivot point so as to assist in the opening of the jaw members 19, 20 and also to hold the jaw members 19, 20 in an opened position until it is desired to close them together to clamp on an object 25 to be grasped. In the drawings an object 25 to be grasped by the self-clamping tool 11 is shown in phantom lines as a cylindrical electrical connector.

Rearwardly of the compression spring 23 is an automatic locking means 27 extending between the members 13, 15 which locks the handle portions and jaw portions in the specific squeezed position reached and prevents their opening up should the user release or loosen his grip on the handles. The jaw members 19, 20 have swivel members 29, 30 on their distal ends to enable the clamping tool 11 to horizontally rotate up to one hundred eighty degrees relative to the object 25 being clamped thus permitting the user to have the most comfortable position for applying the clamping action and applying a turning torque on the clamped object 25.

The first plier-action like member 13 has an upper rear handle 17, a lower forward jaw portion 20, and a housing structure 32 intermediate of its ends having two side plates 55, an upper plate 56, and a lower plate 57 that extends to form the lower jaw portion 20. The upper handle 13 is secured by fasteners 38 to the side plates 55 forming the housing 32 and angles therefrom at an angle of about 45 degrees. These plates 55 are arranged to form a tunnel through which the second plier-action like member 15 extends and pivotally moves. As shown the second member 15 has a forward jaw member 19 that extends above the upper plate 55 and has a short angled portion 39 joining the forward jaw member 19 with a short member 41 internally of the housing. The short member 41 is thick and has a drop extension 43 which joins with a rear extending member 45 orientated similarly to the short member 41 but at a lower level. The short member 41 has integral sides 47 extending a short distance beyond the drop extension 42 so to form a first cavity 50 for a ratchet gear mount 52. The rear handle 18 of the second member 15 integrally extends from the rear extending member 45 at an angle of about 45 degrees so as to be parallel with the upper handle portion 17. The lower rear handle portion 18 is shorter than the upper rear handle 13 and has concaved notches 53 on its lower surface to conform with the fingers of the user and thereby provide a secure grip.

A fastener screw 21 fixed between the side plates 55 forming the housing 32 of the first member 13 extends through a pivot hole in the short angled portion 39 of the second member 15 which permits the two plier-action like members 13, 15 to pivot relative to each other. The rearwardly extending member 45 of the second member 13 together with the upper plate 56 and side plates 55 of the second member 13 forms a second cavity 57 that communicates with the first cavity 50 formed by the short integral sides 47 and drop extension 47 of the second member 15.

Figure 3:
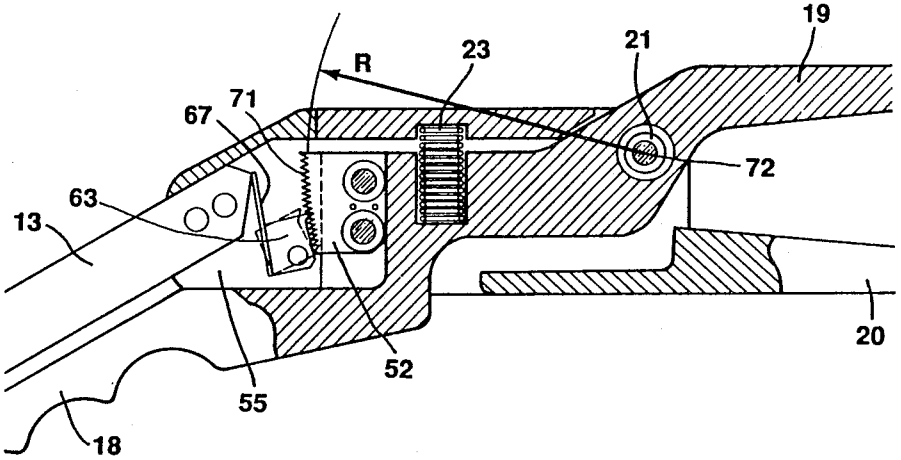
FIG. 3 is a specific view of the locking mechanism for the tool of FIG. 1.

The automatic locking means 27 comprises a ratchet gear 52 partly within the first cavity 50 and secured with fasteners 61 to the two integral sides 47 extending from the short member 47 of the second plier-like member 13 and a pawl 63 within the second cavity 57 and secured to a shaft 65 extending from the side plates 55 forming the housing 32 on the first plier-like member 13. The shaft 65 is located adjacent to the lower forward corner of the pawl block 63 so as to be eccentric thereto. As shown in FIG. 3 the ratchet gear teeth 71 are on a curve at a radius R from the pivot point 72 to form a sector and the gear teeth are configured in a forty-five degree downwardly sloping saw tooth so as to provide capture of the mating pawl 63.

The pawl 63 has a flat cantilevered spring 67 riding at its upper end against the handle 17 ending within the housing side walls 55. The pawl block 63 is secured to the lower part of the flat spring 67 and has an extending pick that engages a ratchet gear tooth. Thus the pawl 63 is spring loaded to engaged the ratchet 52. The shaft 65 extends through the pawl block 63 and is secured thereto and extends into bushings within the side plates 55. One side of the shaft 65 extends through a side plate 55 and a thumb release lever 68 is secured thereto. The shaft 65 is eccentric to the pawl block 63 so that shaft rotation in a counter clockwise rotation, as caused by pushing down on the thumb lever 68, pulls the pawl pick away from the ratchet tooth and permits the two plier-like arms 13, 15 to unlock and open. A dowel 69 extends from the side plate 55 and located beneath the lever 68 to serve as a stop for the lever 68 after it has moved a short distance when pushed down. The dowel stop 69 prevents the over-deflection of the cantilevered spring 67 by the rotation of the shaft 65.

Thus when release of the clamping jaws 19, 20 is desired, the handles 17, 18 are squeezed slightly to unload the pawl block pick 63, and then the thumb released lever 68 is depressed which overcomes the cantilevered spring 67 and pulls the pawl 63 away from the ratchet 52. As previously noted a compression spring 23 is loaded within a hole in the upper surface of the short thick member portion 41 of the second plier-like member 15 and extends into a shallow hole extending from the lower surface of the upper plate 56. The compression spring 23 tends to assist in the opening of the plier-like members 13, 15 until is desired to once again clamp an object.

It should be noted the locking between the pawl 63 and ratchet 52 is augmented by the geometric relationship between the pawl, pawl shaft and ratchet gear because the point of tangency the pawl tooth shares with the ratchet gear causes the clamping load to load drive the tooth into further engagement as the load increases.

The swivel members 29, 30 on the distal ends of the principal elongated jaw members 19, 20 are shown are in the shape of half-circles for grasping a circular electrical fitting 25 shown in phantom lines in the drawings. Each swivel member 29, 30 is pivotally mated to a fastener dowel 90, 91 extending downwardly through the distal end of an elongated jaw member 19, 20. Thus the swivel members 29, 30 rotate about an axis perpendicular to the horizontal axis of the plier-like members 13, 15 and permit the members to swing or rotate in a 180 degrees arc relative to the object 25 to be clasped by the swivel members. The vertical face 95 of each end of the jaw members 19, 20 are curved and have a radius corresponding with the dowel location.

Figure 4:
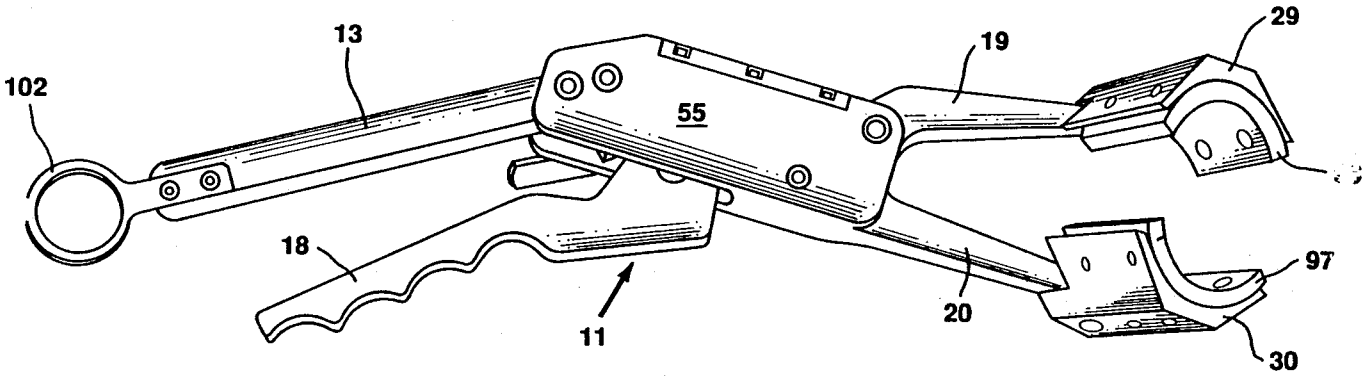
FIG. 4 is a full side view of the self-locking clamping tool with its end swiveled members rotated ninety degrees.

Elastomeric or rubber pads 96, 97 (see FIG. 4) are riveted to the inner surface of the swivel members 29, 30 to provide friction, a tactile feel, and to minimize damage from chafing. The rubber pads 96, 97 conform to the shape of the object 25 being grasped and provides a force when compressed to enhance the pawl 63 engagement. Also as illustrated each swivel member 29, 30 has an inward extending rib 99 adjacent the vertical face of its jaw member which includes a ole confining a spring loaded detent 100 which rides against the curved end face 95 and frictionally holds the swivel member 29, 30 in a desired angular position until clamping is effective.

As the self-clamping tool 11 is designed to fit the needs of the astronaut in space it also has a tether loop 102 fastened to the handle end 17 of the first member 13 to provide a means of keeping the tool 11 at hand should the astronaut need to let go of it temporarily. The tether is usually attached to the astronauts wrist so as keep the tool from floating away in the micro-gravity environment.

It is apparent that a unique clamping tool has been described having a useful locking feature and swivel jaws. It is quickly and easily positioned, locked, and released. It provides to the user a tactile feel of the object being grasped and it requires no adjustment. It frees the user from using his hands for continuous clamping of the handles and therefore enables the user more hand articulation. While the tool has been described relative to its orientation of parts by terms such as upper and lower this is simply a matter of convenience in referring to the drawings and should not be construed as requiring that orientation since the reversed orientation of the tool will function in the same manner.

While the invention has been described relative toa specific embodiment, it is evident that modifications and changes may be made thereto without departing from the scope of the claims.

What is claimed is:

1. A clamping tool comprising:

a first member having a rear handle portion and a forward jaw portion;

a second member having a rear handle portion and a forward jaw portion;

said first and second members being pivotally connected to each other intermediate their ends whereby the handle portion of said first member is above the handle portion of said second member and the jaw portion of said second member is above the jaw portion of said first member so as to have a plier action;

a pair of opposing swivel jaw members;

one of said swivel jaw members rotatively mounted to the end of the jaw portion of said first member, and the other of said swivel members rotatably mounted to the end of the jaw portion of said second member whereby pivoting the handle portions away from each other will pivotally open the opposing swivel jaw members for grasping an object and whereby pivoting the handle portions toward each other will close the opposing jaw members to grasp an object;

said first and second members may rotate relative to said opposing swivel jaw members along an arc to best position said first and second members for operation by an user;

a locking means that permits said first and second members to pivotally close its jaw members as desired on an object to be grasped and locks said jaws members so as not to release an object grasped;

said first member having a housing structure between its handle portion sand its jaw portion;

said housing structure having a two opposing side plates, an upper plate, and a lower plate that extends to form the jaw portion;

said housing structure forming a tunnel through which said second member extends;

said second member having a short angled portion joining its jaw portion and extending within said housing and joined to said angled portion;

said short member extending within said housing having a drop extension which joins with a rear extending member orientated singularly to the short member but at a lower level from which the handle portion of said second member extends;

said first member having a fastener extending between the opposing side plates and through the short angled portion of said second member to permit said first and second members to pivot in a plier action;

said locking means including a ratchet gear secured to the short member of said second member and a pawl pick secured to a shaft extending between said two opposing plates of said first member, said pawl pack selectively engaging the teeth of said ratchet gear as said first and second members are pivotally closed members in the opposite direction;

a spring means biasing said pawl pick into engagement with said ratchet gear;

a release means for rotating said shaft extending between said two opposing plates so as to cause the pawl pick to rotate against said spring means and to disengage from said ratchet gear thereby permitting said first and second members to pivotally open from a closed position.

2. A clamping tool according to claim 1 further comprising;

said ratchet gear having a tooth surface along a circle with a radius extending from the pivot point of said first and second members.

3. A clamping tool according to claim 2 further comprising:

elastomeric pads attached to the opposing surfaces of said swivel jaw members.

4. A clamping tool according to claim 1 further comprising:

said opposing swivel jaw members having a detent means for holding said swivel jaw members in select positions relative to the jaw portions of said first and second members.

5. A clamping tool according to claim 1 further comprising:

spring means extending between said first and second members to assist in the pivoting opening of said handle portions and jaw portions.

6. A clamping tool according to claim 5 further comprising:

a stop to prevent rotation of said shaft secured to said pawl pick beyond a certain limit.

7. A clamping tool according to claim 6 further a lever fastened to said shaft secured to said pawl pick, said lever positioned outside of said housing structure so as to be pushed when desired by the user holding said rear handle portions of the first and second members.

8. A clamping tool according to claim 5 further comprising: a tether loop attached to one of the handle portions of said first and second members.

* * * * *